US005099582A

United States Patent [19]

Chang

[11] Patent Number: 5,099,582

[45] Date of Patent: Mar. 31, 1992

[54] VARIABLE PERSPECTIVE VIEWING DEVICE

[76] Inventor: Hwang N. Chang, 109 Franklin St., Newark, N.Y. 14513

[21] Appl. No.: 710,601

[22] Filed: Jun. 5, 1991

[51] Int. Cl.[5] ..... B43L 7/06

[52] U.S. Cl. ..... 33/464; 33/DIG. 9; 33/1 K; 33/565

[58] Field of Search ..... 33/1 K, DIG. 9, 562, 33/565, 276, 277, 464

[56] References Cited

U.S. PATENT DOCUMENTS

| | | | |
|---|---|---|---|
| 1,976,278 | 10/1934 | Cook | 33/DIG. 9 X |
| 2,193,518 | 3/1940 | Lubin . | |
| 2,342,525 | 2/1944 | Berry | 33/DIG. 9 X |
| 2,463,163 | 3/1949 | Dubner . | |
| 3,096,587 | 7/1963 | Kenney . | |
| 4,498,238 | 2/1985 | Vaughn . | |
| 4,584,779 | 4/1986 | Wakamatsu | 33/DIG. 9 X |

FOREIGN PATENT DOCUMENTS

| | | | |
|---|---|---|---|
| 233961 | 4/1911 | Fed. Rep. of Germany | 33/277 |
| 1193082 | 4/1959 | France | 33/DIG. 9 X |

*Primary Examiner*—Harry N. Haroian
*Attorney, Agent, or Firm*—Henderson & Sturm

[57] ABSTRACT

A device (10) for use by artists, draftsmen and the like for aid in perspective viewing. The device comprises first (11) and second (12) framework units, which when moved with respect to one another form a variable dimension rectangular aperture to vary the field of view of the user.

1 Claim, 2 Drawing Sheets

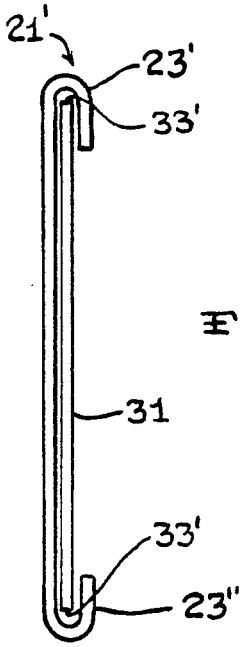
FIG. 5.
FIG. 6.
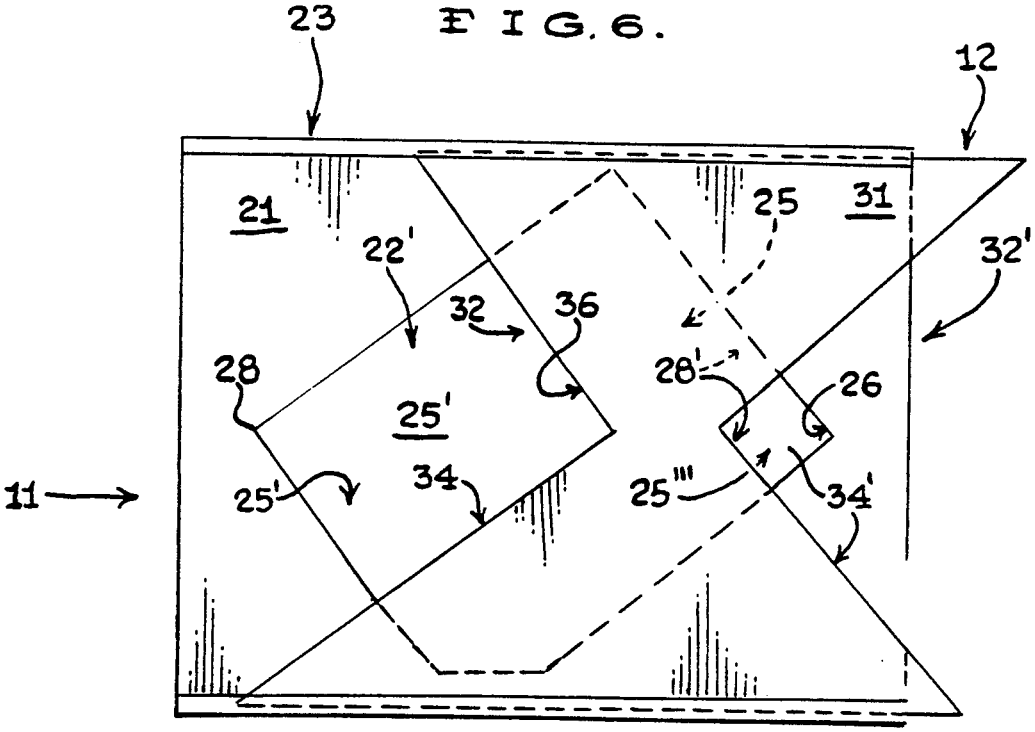

VARIABLE PERSPECTIVE VIEWING DEVICE

TECHNICAL FIELD

The present invention relates to the field of perspective viewing devices in general, and in particular to a perspective viewing device which can operatively vary the scope of sight of the user.

BACKGROUND ART

This invention was the subject matter of Document Disclosure Program Registration No. 265367 filed in the United States Patent and Trademark Office on Oct. 19, 1990.

As can be seen by reference to the following U.S. Pat. Nos. 2,193,518; 2,463,163; 3,096,587; and 4,498,238, the prior art is replete with myriad and diverse perspective viewing devices.

While all of the aforementioned prior art constructions are more than adequate for the basic purpose and function for which they have been specifically designed, these prior art constructions are uniformly deficient in that the field of view which they provide for the user is not variable. In many of the prior art constructions the device is often bulky and/or expensive to produce, which limits the utilitarian aspect of these particular designs.

As a consequence of the foregoing situation, there has existed a longstanding need for a new type of variable perspective viewing device wherein the field of view that the device provides to the user can be selectively altered and whose construction is both lightweight and inexpensive. The provision of such a construction is a stated objective of the present invention.

DISCLOSURE OF THE INVENTION

Briefly stated, this invention comprises a variable perspective viewing device having a first framework unit and a second framework unit which may be moved with respect to one another, thereby forming a generally rectangular aperture of variable dimension. The first framework unit is provided with an opening and a track member. The second framework unit is provided with an opening and a track follower member.

As will be explained in greater detail further on in the specification, the device may be used to operatively vary the field of view of the user. The device always provides the user with a generally rectangular aperture of variable dimension.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 5 is an end view of another version of the track and track follower arrangement that ma also be employed in this invention; and, FIG. 6 is a front plan view of yet another version of the preferred embodiment of the invention.

BEST MODE FOR CARRYING OUT THE INVENTION

Figure 1:
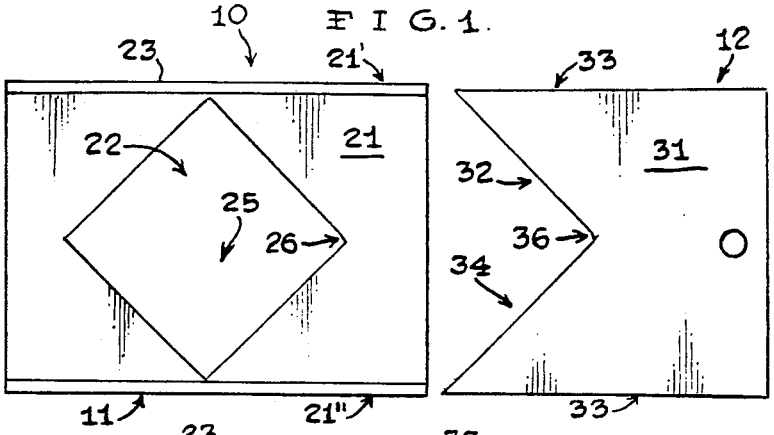
FIG. 1 is a front plan view of one version of the preferred embodiment of the invention.

As can be seen by reference to the drawings, and in particular to FIG. 1, the variable perspective viewing device that forms the basis of the present invention is designated generally by the reference numeral (10). The device (10) comprises in general a first framework unit (11) and a second framework unit (12) which are operatively engaged in a reciprocating fashion relative to one another. These units will now be described in seriatim fashion.

Figure 2:
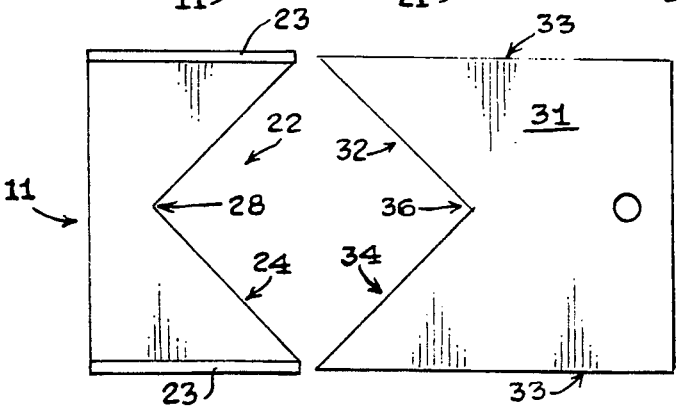
FIG. 2 is a front plan view of another version of the preferred embodiment of the invention.
Figure 3:
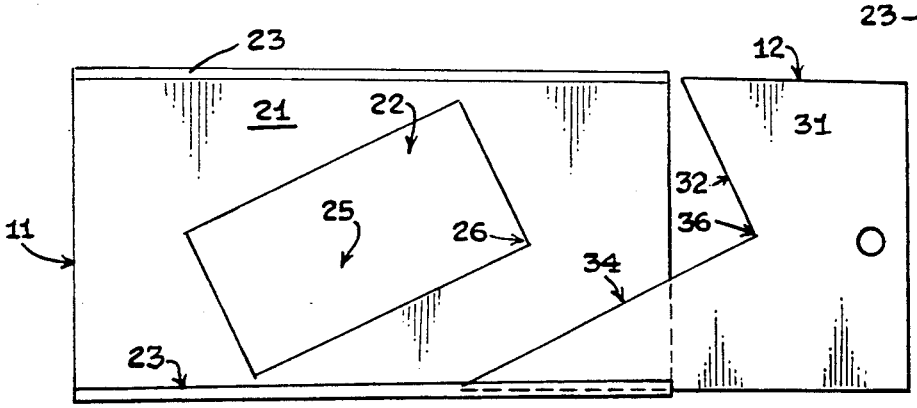
FIG. 3 is a front plan view of an alternate embodiment of the version depicted in FIG. 1.

As can best be seen by reference to FIGS. 1 through 3, the first framework unit (11) comprises a first plate member (21). The plate member (21) is provided with an opening (22) and a pair of track elements (23) formed on the upper (21') and lower (21'') edges of the first plate member (21). It should further be noted that the opening (22) is a generally right-angled recess (24) in one version of the preferred embodiment depicted in FIG. 2. In other versions of the preferred embodiment depicted in FIGS. 1 and 3, opening (22) forms a rectangular aperture (25).

Again, referring to FIGS. 1 through 3, it can be seen that the second framework unit (12) comprises a second plate member (31). The second plate member (31) is provided with an opening (32) and upper and lower tracks engaging surfaces (33) adapted to operatively and slidably engage the track element (23) of the first framework unit (11). It should further be noted that the opening (32) in all of the versions of the preferred embodiments is a generally right-angled recess (34).

In the first version of the preferred embodiment shown in FIGS. 1 and 3, the opening (22) of the first framework unit (11) comprises a generally angled rectangular aperture (25). In the version of F]g. 1, the aperture defines a square. In the version of FIG. 3, the aperture defines an elongated rectangle.

In addition, the second framework unit (12) in all of the versions is further provided with a generally right-angled recess (34). The construction is such that when the second framework unit (12) operatively engages the track element (23) of the first framework unit (11), the vertex (36) of the recess (34) aligns along the same horizontal axis as the outer vertex (26) of the generally rectangular aperture (25).

In the second version of the preferred embodiment shown in FIG. 2, the opening (22) of the first framework unit (11) comprises a generally right-angled recess (24). The second framework unit (12) is also provided with a generally right-angled recess (34). The construction is such that when the second framework unit (12) operatively engage the track elements (23) of the first framework unit (11), the vertex (36) of the recess (34) of the second framework unit (12) operatively aligns with the vertex (28) of the recess (24) of the first unit (11).

The operation of the device is as follows. The track engaging surfaces (33) are adapted to operatively and slidably engage the track elements (23) of the first framework unit. The first and second framework units are free to reciprocate relative to one another. As the second framework unit (12) is moved towards the first framework unit (11), the recess (34) intersects the rectangular opening (25) thereby forming an aperture (not shown). By varying the position of the second framework unit (12) relative to the first framework unit (11) many differently dimensioned rectangular apertures may be formed.

Figure 4:
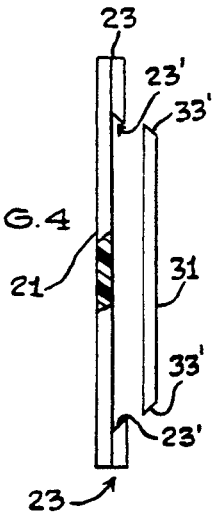
FIG. 4 is an end view of one version of the track and track follower arrangement which may be employed in the invention.

It should also be noted that as shown in FIGS. 4 and 5, different varieties of track and track engaging constructions could be employed in the invention.

As can be seen by reference to FIG. 4, one such track and track engaging arrangement involves the use of dovetail recesses (23') being formed in the track elements (23) of the first plate member (21). The track engaging surfaces are provided with tapered sides (33') which are dimensioned to be slidably received in the dovetail recesses (23').

In the other track and track engaging arrangement depicted in FIG. 5, the upper (21') and lower (21'') surfaces of the first plate member (21) are curled inwardly to form channels (23'') which are dimensioned to receive the track engaging surfaces (33'') of the second plate member (31).

In the third version of the preferred embodiment depicted in FIG. 6, it can be seen that the opening (22') of the first framework unit (11) defines a pentagon shaped opening (25'); wherein, the second framework unit (12) is provided with two oppositely faced openings (32) and (32') defining right angled recesses (34) (34').

Furthermore as clearly shown in FIG. 6, the left hand opening (32) in the second plate member (31) cooperates with the opening (25') of the first plate member (21) to define a variable dimension rectangular opening (25'') on the left hand side of the first plate member (21); while, the right hand opening (32') in the second plate member (31) cooperates with the opening (25') of the first plate member (21) to define a variable dimension square opening (25'') on the right hand side of the first plate member (21). In this way two different shaped variable openings (25'') and (25'') are created by the two plate members (21) and (31) for the purposes of variety and convenience Having thereby described the subject matter of the present invention, it should be apparent that many substitutions, modifications and variations of the present invention are possible in light of the above teachings. It is therefore to be understood that the invention as taught and described herein is only to be limited to the extent of the breadth and scope of the appended claims.

I claim:

1. A variable perspective viewing device for varying the field of the user wherein the device comprises:

a first framework unit including a first plate member provided with an enlarged opening having at least two vertically offset and opposed right angles defined by the opening; and, at least one track element; and, a second framework unit including a second plate member provided with a pair of oppositely faced notches defining right angled recesses; wherein, each of the junctures of the notches is aligned with one of the junctures of the said at least two right angles formed in the enlarged opening of the first plate member; and, at least one track engaging surface on the second plate member adapted to operatively engage said the at least one track element of the first framework unit; wherein, the first and second framework units may be moved relative to one another such that: one of said right angled notches cooperates with one side of the enlarged opening in the first plate member to define a variable dimension rectangular aperture; and, the other of said right angled notches cooperates with the other side of the enlarged opening in the first plate member to define a variable dimension square aperture.

* * * * *